US007708072B1

(12) United States Patent
Hunziker

(10) Patent No.: US 7,708,072 B1
(45) Date of Patent: May 4, 2010

(54) ACCESSORIES AND METHOD FOR HOLLOW STEM AUGER RETRACTION

(76) Inventor: David G. Hunziker, P.O. Box 211, Fort Scott, KS (US) 66701

( * ) Notice: Subject to any disclaimer, the term of this patent is extended or adjusted under 35 U.S.C. 154(b) by 679 days.

(21) Appl. No.: 11/546,924

(22) Filed: Oct. 11, 2006

Related U.S. Application Data

(63) Continuation-in-part of application No. 11/399,716, filed on Apr. 5, 2006, now abandoned.

(60) Provisional application No. 60/668,473, filed on Apr. 5, 2005, provisional application No. 60/732,971, filed on Nov. 3, 2005.

(51) Int. Cl.
*E21B 31/12* (2006.01)

(52) U.S. Cl. ..... 166/301; 294/90; 294/103.2

(58) Field of Classification Search ..... 166/301; 294/86.1, 86.13, 86.4, 90, 103.2, 104, 105; 81/57.2, 57.21
See application file for complete search history.

(56) References Cited

U.S. PATENT DOCUMENTS

| | | | | |
|---|---|---|---|---|
| 137,592 | A | 4/1873 | Burkhart | 294/106 |
| 308,483 | A | 11/1884 | Forshey | 294/106 |
| 613,369 | A | 11/1898 | Hirlinger | 294/86.29 |
| 720,078 | A | 2/1903 | Smith et al. | 294/86.28 |
| 760,219 | A | 5/1904 | Lisle | 294/86.14 |
| 879,812 | A | 2/1908 | Button et al. | 294/86.13 |
| 886,003 | A | 4/1908 | Kraft | 294/19.3 |
| 1,150,581 | A | 8/1915 | Lan | 294/82.32 |
| 1,207,219 | A | 12/1916 | Rush | 294/106 |
| 1,223,034 | A | 4/1917 | Colgan et al. | 294/86.13 |
| 1,290,127 | A | 1/1919 | Drake | 294/86.13 |
| 1,352,172 | A | 9/1920 | Brandon | 294/86.26 |
| 1,365,196 | A | 1/1921 | Richardson | 294/106 |
| 1,455,499 | A | 5/1923 | Lang | 294/86.2 |
| 1,511,061 | A * | 10/1924 | Nebergall | 294/86.3 |
| 1,513,023 | A | 10/1924 | Bartlett | 294/106 |

(Continued)

FOREIGN PATENT DOCUMENTS

JP 7144689 A * 6/1995

(Continued)

OTHER PUBLICATIONS

National Driller vol. 26 No. 12 Dec. 2005.

*Primary Examiner*—Daniel P Stephenson
(74) *Attorney, Agent, or Firm*—Jonathan A. Bay

(57) ABSTRACT

Withdrawing a hollow stem auger string from a well includes a retractor having C-shaped inter-coil insertions and a hoist having tong-arms, one which terminates in an inwardly disposed pin. The retractor connects to a drilling rig's hydraulic cylinder vertical drive system, the hoist to a winch system thereof. The retractor engages the string by the C-shaped inter-coil insertion disposed between one coil of the helical flight of the topmost section of the string. The hoist engaged the top collar of the topmost section by the at least one pin inserting into a pin hole thereof. The string is lifted about the height of one section by the retractor, which is promptly disengaged. The topmost section is detached, and carried by the hoist to elsewhere to be dropped. The method repeats by re-engaging the retractor and hoist and then returning to the activity of lifting.

14 Claims, 11 Drawing Sheets

U.S. PATENT DOCUMENTS

| | | | | | |
|---|---|---|---|---|---|
| 1,517,130 | A | | 11/1924 | Ruppert | 294/106 |
| 1,526,174 | A | | 2/1925 | Obermuller | 294/86.29 |
| 1,533,853 | A | | 4/1925 | Grant | 294/106 |
| 1,542,099 | A | | 6/1925 | Rogers | 294/86.29 |
| 1,587,021 | A | | 6/1926 | Montgomery | 294/86.29 |
| 1,673,130 | A | | 6/1928 | Walsh | 294/106 |
| 2,324,361 | A | | 7/1943 | Chandler | 294/104 |
| 2,354,107 | A | | 7/1944 | Diamond | 294/82.13 |
| 2,422,865 | A | | 6/1947 | Tucker | 248/228.4 |
| 2,454,317 | A | * | 11/1948 | Hambly | 81/57.34 |
| 2,670,985 | A | | 3/1954 | King | 294/106 |
| 2,819,924 | A | | 1/1958 | Hayes | 294/67.13 |
| 2,857,193 | A | | 10/1958 | Heppenstall | 294/67.13 |
| 2,958,557 | A | | 11/1960 | Cianchette | 294/106 |
| 3,097,875 | A | | 7/1963 | Kaplan | 294/67.31 |
| 3,527,309 | A | | 9/1970 | Rassieur | 173/28 |
| 3,561,545 | A | | 2/1971 | Rassieur | 173/166 |
| 3,942,834 | A | | 3/1976 | Kawaguchi | 294/110 R |
| 3,958,825 | A | | 5/1976 | Diamond | 294/78 R |
| 3,975,045 | A | | 8/1976 | Abarotin et al. | 294/86 R |
| 4,023,848 | A | | 5/1977 | Bennett | 294/88 |
| 4,195,873 | A | | 4/1980 | Johnston | 294/106 |
| 4,221,419 | A | | 9/1980 | Riley et al. | 294/106 |
| 4,303,269 | A | | 12/1981 | Faughnan | 294/86 R |
| 4,334,444 | A | * | 6/1982 | Carstensen et al. | 81/57.18 |
| 4,638,871 | A | | 1/1987 | Rassieur | 173/26 |
| 4,944,543 | A | | 7/1990 | Walsh | 294/86.29 |
| 5,116,341 | A | | 5/1992 | Cameron | 294/67.3 |
| 5,171,053 | A | | 12/1992 | Rouleau | 294/106 |
| 5,303,968 | A | | 4/1994 | Trine | 294/106 |
| 5,481,244 | A | * | 1/1996 | Dicke | 340/473 |
| 5,755,476 | A | | 5/1998 | Hosking | 294/106 |
| 6,036,247 | A | | 3/2000 | Gertz et al. | 294/67.31 |
| 6,131,978 | A | | 10/2000 | Rounds | 294/106 |
| 6,168,219 | B1 | | 1/2001 | Futa | 294/3 |
| 6,398,282 | B1 | | 6/2002 | Mononen | 294/106 |
| 6,457,761 | B1 | | 10/2002 | Benoit | 294/86.41 |
| 6,474,712 | B1 | | 11/2002 | Govzman et al. | 294/106 |
| 2002/0119030 | A1 | * | 8/2002 | Hensler | 414/23 |
| 2005/0232700 | A1 | * | 10/2005 | Timmerman | 405/31 |

FOREIGN PATENT DOCUMENTS

| | | | |
|---|---|---|---|
| SU | 874972 B | * | 10/1981 |

* cited by examiner

ACCESSORIES AND METHOD FOR HOLLOW STEM AUGER RETRACTION

CROSS-REFERENCE TO RELATED APPLICATION(S)

This application is a continuation-in-part of U.S. patent application Ser. No. 11/399,716, filed Apr. 5, 2006 now abandoned, which claims the benefit of U.S. Provisional Application No. 60/668,473, filed Apr. 5, 2005, and U.S. Provisional Application No. 60/732,971, filed Nov. 3, 2005, portions of which were originally presented as U.S. Provisional Application No. 60/645,639, filed Jan. 21, 2005. All the foregoing patent applications are fully incorporated herein by reference.

BACKGROUND AND SUMMARY OF THE INVENTION

The invention relates to hoisting devices and, more particularly, to accessories and methods for hollow stem auger retraction from downhole in (eg., from down in the hole of) a well bore. The conventional occasion nowadays for wanting to withdraw a string of hollow stem auger sections from a well bore is during construction of an environmental monitoring well.

Briefly, groundwater monitoring/remediation wells are bored into the earth. A bore hole is formed by down-feeding a string of hollow stem auger sections. What is loosely referred to as an "auger" is actually more technically accurately referred to as a string—or end to end assembly—of numerous individual sections of hollow stem auger sections. FIGS. 7 and 8 (among others) shows the top end of one such section 21 (ie., a hollow stem auger section 21).

Briefly, FIGS. 7 and 8 show that the hollow stem auger section 21 has a hollow stem (naturally enough) that at the top end thereof is necked down to form a top collar 22. The remainder of the hollow stem auger section 21's hollow stems outer surface support a helical flight 23, which helical flight 23 typically has a pitch about equal to the outside diameter thereof. The top collar 22 is provided with features and adaptation to couple with a drill cap 24. That is, the top collar is formed with four angularly-spaced, vertical, external flutes 25 and two diametrically opposite pin holes 26. Correspondingly, the drill cap 24 has four angularly-spaced, vertical, external splines 27 and two diametrically opposite pins 28 (or bolts).

Now let's turn to the matter of boring a bore hole to its deepest depth. An auger string is progressively elongated by the addition of additional sections 21 in an end to end assembly thereof (this is not shown, and the bottom end of each section is formed with a bottom collar which has counterpart formations as the drill cap 24). This activity of progressively elongating the auger string takes place in alternating fashion with boring out the bore hole about the length of one such section 21. When the deepest depth is reached, the auger string is typically not just stopped at the deepest depth but retracted a foot or so (~30 cm). Then, the drill cap 24 is displaced off the topmost section 21 (eg., as shown in FIG. 7). A sand and/or grout footing is poured into the hollow center (lumen) of the hollow stem auger string. Then an undersized casing is inserted into the lumen of the hollow stem auger string all the way to where it bottoms out onto the recently poured in footing.

Typically the casing comprises an assembly of PVC pipe sections which are twisted together with counterpart internal and external threaded ends to form a sealed string of casing sections as a whole. However, the first section of the casing string comprises a screen section. The screen section is typically a ventilated stainless steel assembly to allow groundwater to seep in at the lowest ten feet (~3 m) or so of the monitoring/remediation well.

Again, the casing—typically a string or end-to-end assembly of PVC pipe sections twisted together by the counterpart internal and external threaded ends thereof—is undersized:—relative to, that is, the lumen of the hollow stem auger string in which it is inserted. Thereafter, the hollow stem auger string is withdrawn from the bore, leaving the PVC-pipe casing string in place. Thus such an undersized casing string presents an annular gap between the bored earth and PVC pipe sections. This annular gap is then backfilled. About the lowest ten feet (~3 m) or so surrounding the screen section is backfilled with sand, to allow seepage of groundwater. The remaining depth (dozens or hundreds of feet or meters) is backfilled with cement or the like, bentonite being a common substitute, to disallow the seepage of groundwater.

Well casings are specified among three or so standard sizes and according to pipe diameter. For example and without limitation, a remediation well might be specified to be cased with any of two-inch pipe, four-inch pipe, or six-inch pipe and so on (eg., about five, ten and fifteen cm O.D. respectively). If two-inch pipe is specified, then the lumen of the hollow stem auger string typically measures about 4¼ inches (~11 cm) inside diameter. The PVC pipe typically measures about 2⅓ inches (~6 cm) O.D. During withdrawal of the hollow stem auger string, an extension of the PVC pipe is left poking up out the top of lumen of the hollow stem auger string so that none of the footing back fill is errantly poured into the casing string's hollow core (and into the inside of the screen).

To turn to another matter of the prior art, there is another piece of the background to note, which involves the field equipment used by the workers in this industry:—eg., their drilling rigs. Namely, such drilling rigs have two kinds of devices for retracting the hollow stem auger string:—ie., one being hydraulically-winched cables or lines, in contrast to, the other being hydraulic cylinders.

It might be noted that hydraulically-winched cables and lines, when used to pull free a stuck object, typically include the danger of recoil. Conversely, hydraulic cylinders are essentially recoilless in the same situation. Also, the hydraulic-cylinder systems of such drilling rigs are powerful, and typically outmuscle the power of the hydraulic winches by several times.

A typical drilling rig utilized in the industry might comprise, for example and without limitation, a CME 750 All-terrain (rubber tire) vehicle drilling rig of the Central Mine Equipment Company in St. Louis, Mo. This is the carrier/drilling rig combination which is approximately illustrated in several patents of the CME Company, and for more particular disclosure of such carrier/drilling rig features, reference may be had to any of U.S. Pat. Nos. 3,527,309; 3,561,545 and/or 4,638,871—all of which are by C. L. Rassieur. The foregoing patent disclosures are incorporated fully herein by this reference thereto.

Such a carrier/drilling rig has a two-piece tower comprising, in the lower portion thereof, an undergirding upright, upon which is affixed a removable mast. The crown of the mast might be outfitted with as many as five sheaves. In a five sheave configuration, typically one sheave serves a wireline cable and winch, another serves softlines perhaps pulled by a cathead, and the remaining three would typically serve three cable-and-winch systems for winching up (eg.) sections of drill rod. The wireline cable and softline-cathead system are not pertinent to the present invention. Typically the wireline cable system reels up a wire relatively fast but with a weak hoist (eg., able to exert 900 pounds or ~400 kg of force or so) and is utilized in rock-coring, for example. The cathead is like a capstan on a ship, except oriented on a horizontal turning axis, and can winch in by means of one or two loops of not only softlines but also cables and/or chains as well. It typically is a weak system too.

Stronger still are the (three or so) cable-and-winch systems. It is typical to equip the drilling rig with winches rated between about 1,800 or to 3,200 pounds (~700 to ~1,400 kg). It is also known to include at least one cable-and-winch system as a main one for fishing stuck objects and the like, and provide it with a retraction-force rating as high 10,000 pounds (~4,500 kg). Again, these three cable-and-winch systems are designed for, among other end uses, lifting up sections of drill rod. The height of the tower to the crown of the mast is typically something greater than twenty feet (~6 m) since that is a standard length of sections of drill rod. The above-ground height of the sheaves for the CME 750 ATV is about twenty-seven and a-half feet (~8⅓ m), which means that workers can hoist the twenty-foot rods with clearance to spare. When the CME 750 ATV is equipped with three such hoists (ie., cable-and-winch systems), workers can pull sixty feet of rods without having to lay any down on the ground or on the deck.

The upright (again, which undergirds the detachable mast) comprises legs and a standing rotary drive shaft (eg., a kelly bar, sometimes a square bar). The standing rotary drive bar typically has a lower end anchored in a main rotary drive and an upper end held in a bearing. The legs carry between (or among) themselves a traveling rotary table. Drive input to the rotary drive table is received from the standing rotary drive shaft as the traveling rotary table transits up and down the standing rotary drive shaft. The drill drive is typically a pair of serially-suspended links interconnected by a U-joint.

The hydraulic vertical drive system for cycling the traveling rotary drive table between feed (eg., pulldown) and retraction strokes typically comprises hydraulic cylinders which serve double-duty as the legs for the upright. The main rotary drive and the hydraulic vertical drive system are typically the strongest systems on the carrier/drilling rig. That is, the main rotary drive might deliver 10,000 ft-lbs (~13,5000 Nm) of rotary torque. The hydraulic vertical drive system can typically deliver a feed (pulldown) force in excess of the weight of the vehicle, or something on the order of 20,000 pounds (~9,000 kg).

The outstanding feature of the hydraulic vertical drive system is the retraction force it can develop:—30,000 pounds (~13,600 kg) for the CME 750 ATV, and then 40,000 pounds (~18,000 kg) being no problem for other models. As an aside, another aspect of the hydraulic vertical drive system is that its drive stroke is only about five and a-half feet (~1⅓ m), but which works out to be sufficient for clearance of sections of hollow stem augers, since they conventionally are a standard five feet (~1½ m) in length.

More importantly, the hydraulic vertical drive system has no cables which can stretch (nor chains which need lubrication). Better yet, the hydraulic vertical drive system is substantially recoilless. When feeding down or retracting up against a stuck hollow stem auger string, as soon as the sticking force is overcome the hydraulic vertical drive system does not recoil. In contrast, cables stretch or the stuck hollow stem auger string (if being retracted up) can let fly after being unstuck (or after being torn apart), chains can whip and so on. Moreover, cables can snap, so can chains. Accordingly, the hydraulic vertical drive system gives precise control over the force applied to downhole tools or objects.

Arguably most significant of all is that, its brute power aside and in spite of being the most powerful system on the carrier/drill rig, the hydraulic vertical drive system is probably the safest.

Now let's return the discussion back to the present problem. Hollow stem auger sections 21 interconnect with each other by their top and bottom collars (only a top collar 22 is shown in FIGS. 7 and 8). The topmost hollow stem auger section 21 is down fed into the bore hole by the drill cap 24 attached to the drill drive (not shown, or extension thereof, also not shown) of the drill rig (not shown). FIGS. 7 and 8 shows a drill cap 24 and the top collar 22 of the hollow stem auger section 21. As previously described, the top collar 22 has four angularly-spaced, vertical, external flutes 25 and two diametrically opposite pin holes 26. Correspondingly, the drill cap 24 has four angularly-spaced, vertical, external splines 27 and two diametrically opposite pins 28 (or bolts). By such formations and/or adaptations, the drill cap 24 and top collar 22 couple as shown in FIG. 8.

During the withdrawal of the hollow stem auger string, an extension of the PVC pipe is typically poking up out the lumen of the hollow stem auger string. Hence the drill cap 24 cannot be coupled to the top collar 22 of topmost hollow stem auger section 21 of the hollow stem auger string. The reasons include either because sand, mud or grout has caked and fouled the top collar 22's flutes 25, or else because the poking up PVC pipe is in the way.

Again, when constructing a well, workers usually have made a mess (understandably so, since it is a messy process in an environment of messy materials) on the top collar 22 of the topmost section 21 of the hollow stem auger string. Hence they cannot reliably get the drill cap 24 to couple. Sometimes, the PVC casing pipe floats up a little bit which adds to the height of the poking up part. So to date workers in this industry have been predominantly relying on a single hook device of the prior art.

To be more particular, since this is important to understanding the shortcomings of the prior art, such prior art hollow stem auger hoists typically comprise a single hook construction. That is, prior art hollow stem auger hoists have just one hook to insert in one or the other of the two diametrically opposed pin holes 26 in the top collar 22 of the topmost section 21 of the hollow stem auger string. Shortcomings with the prior art single hook include (1) it pulls the hollow stem auger string from an axis that is offset from the central axis of the string, (2) and this in consequence tends to bind the single hook in the hole 26, either sometimes deforming the hole 26 in consequence, and/or during other times, making it difficult for a worker to manually pull the hook out of the hole 26, and (3) when winching the bare hook up on a cable around the work site and equipment thereof, the bare hook frequently catches an unintended piece of equipment, such as and without limitation any part of the two-piece tower, either the undergirding upright or the affixed a removable mast. Hence the hook can catch and damage a piece of equipment or such structure/superstructure thereof.

Nevertheless, drillers have been accustomed to the single hook method of withdrawing the hollow stem auger string, and then continuing to use the hook to support the topmost hollow stem auger section 21 as it is disengaged from the string and set aside (eg., as on the ground, or on storage racks).

What is needed is a solution to overcome the shortcomings of the prior art.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
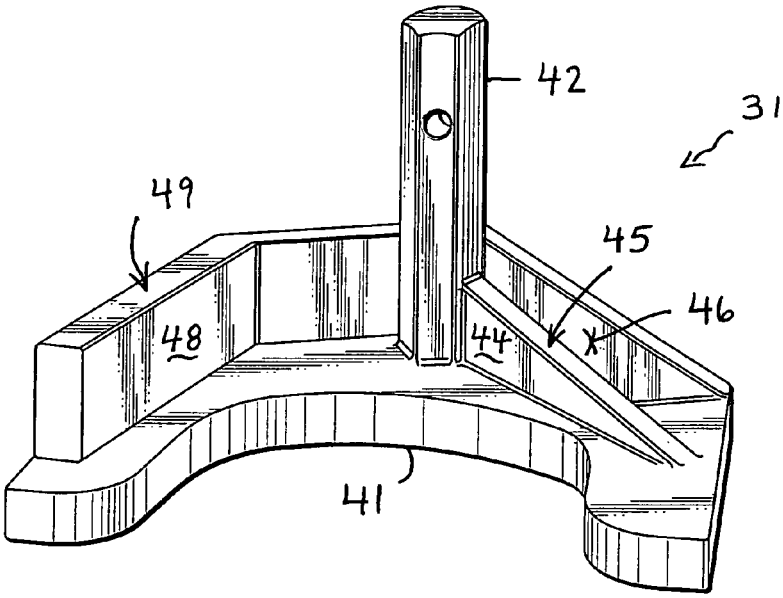
FIG. 1 is a front perspective view of one embodiment of a retractor in accordance with the invention for hollow stem auger strings.
Figure 11:
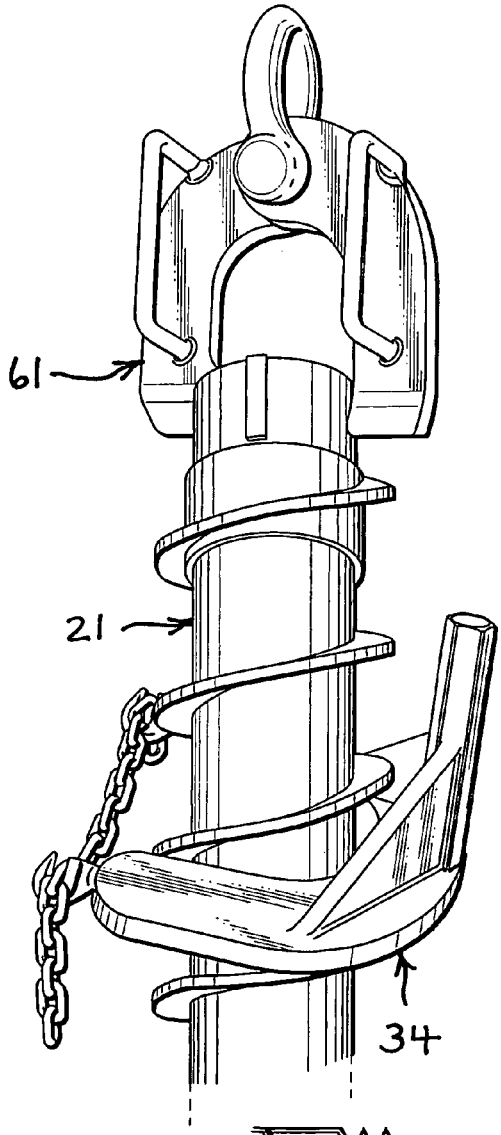
FIG. 11 is a perspective view showing both the hoist coupled to a hollow stem auger section as in FIG. 10 along with a retractor in accordance with the invention and in accordance with the embodiment of FIGS. 5 and 6 coupling to the helical flight of such hollow stem auger section.
Figure 12:
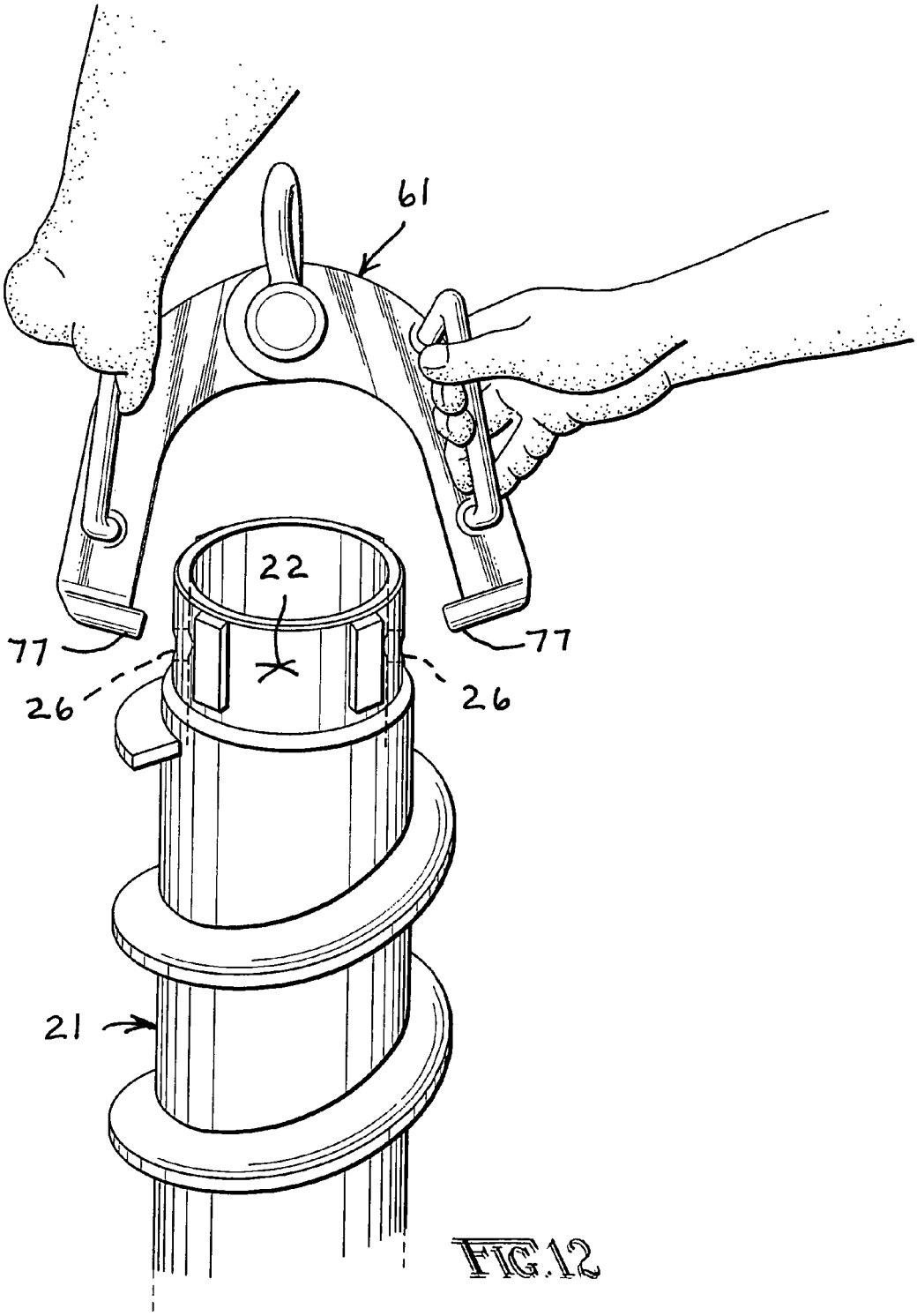
FIG. 12 is a perspective view comparable to FIG. 11 except showing the hoist being manually uncoupled.
Figure 13:
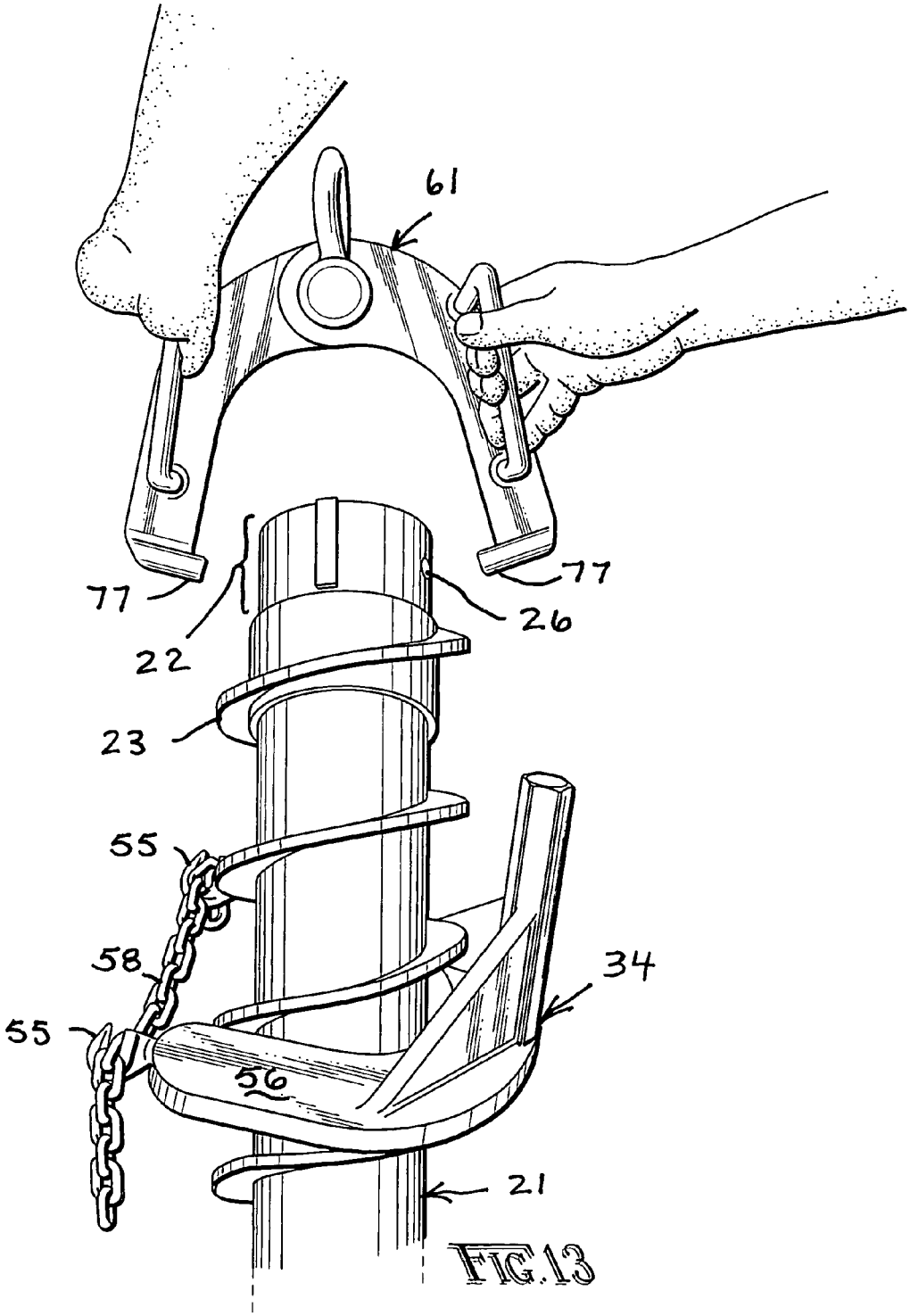
FIG. 13 is a reduced scale perspective view comparable to FIG. 12 except also showing the retractor of FIG. 11.

FIG. 1 shows one embodiment of a retractor 31 in accordance with the invention for retracting a string or end-to-end assembly of hollow stem auger sections 21 from the bore for a well hole. The retractor 31 comprises a C-shaped base plate 41, an upright connection link 42 welded to the base plate 41, and flanking sets of gussets 44, 46 and 48. The C-shaped base plate 41 is formed to insert in the gap between coils of the helical flight 23 and straddle the stem of a hollow stem auger section 21 (see, eg., FIG. 11).

Clockwise from the upright link 42 there are not one but two gussets 44 and 46. The inboard gusset 44 has a down-sloping top or support edge 45 sloped at an oblique angle in order to not only strengthen the connection between the base plate 41 and upright link 42 but also to undergird a section of the flight 23 of the hollow stem auger section 21. That is, the down-slope angle is chosen to match the angle of the pitch of the helical flight 23 of the hollow stem auger sections 21. The outboard, outlying gusset 46 is spaced far radially-out enough such that it would not be admitted in the gap between coils of the helical flight 23 before the upright link 42 is stopped against the peripheral edge of the helical flight 23. The outboard, outlying gusset 46's function is solely to strengthen the connection between the base plate 41 and upright link 42.

Preferably the C-shaped base plate 41, upright link 42, and all gussets therefor (eg., and without limitation, 44, 46 and 48) are all fabricated out of steel stock that allows joining by welding or the like.

The lone gusset 48 to left counterclockwise from the upright link 42 has a relatively level (eg., horizontal) top edge 49. This gusset 48 is spaced inboard enough such that it is admitted in the gap between coils of the helical flight 23. However, since the top edge 49 thereof does not slope up at an angle corresponding to that pitch of the helical flight 23 of the hollow stem auger section 21, this gusset 48 provides no support (contact) during lifting operations.

Figure 2:
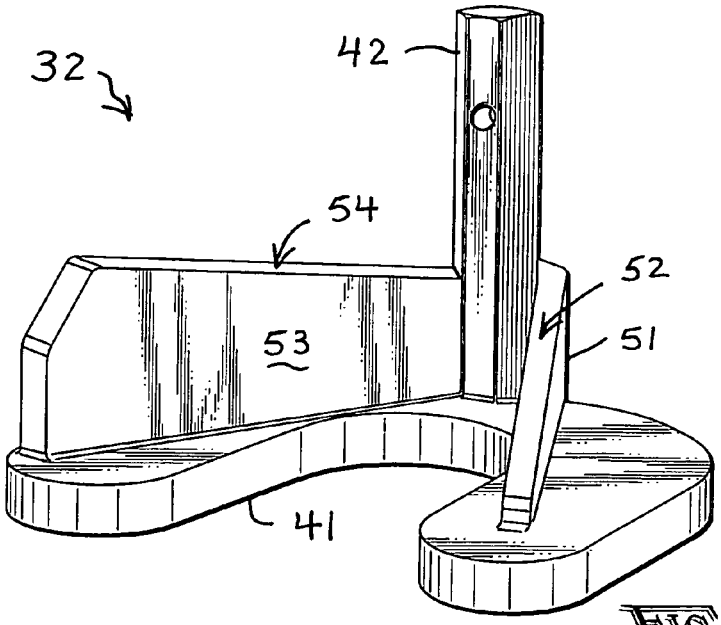
FIG. 2 is a perspective view comparable to FIG. 1 except of a comparable version of the invention that is spun a quarter turn clockwise.

FIG. 2 shows an alternate embodiment of a retractor 32 which is comparable to the FIG. 1 retractor 31 except as follows. There is only one gusset 51 clockwise from the upright link 42, which has a down-sloping top or support edge 52. This down-sloping gusset 51 is positioned and adapted to insert in the gap between coils of the helical flight 23 of a hollow stem auger section 21. Also, the lone gusset 53 counterclockwise from the upright link 42 has an upsloping top edge 54. That way, ideally, both the down-sloping and upsloping gussets 51 and 53 could ideally provide support under a section of the helical flight 23 for about half a coil, in contrast to the FIG. 1 retractor 21 which supports about a quarter or less of a coil. However, experience teaches that the flaring terminal end of the upsloping gusset 53 makes the upsloping gusset 53 unwieldy to insert between coils of the helical flight 23.

Figure 3:
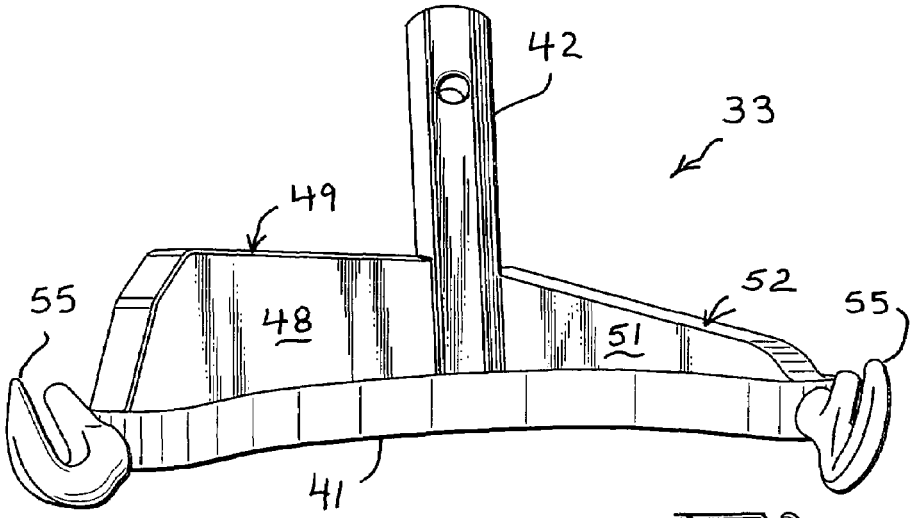
FIG. 3 is a front elevational view of an alternate version of the FIGS. 1 and 2 embodiment of the invention.
Figure 4:
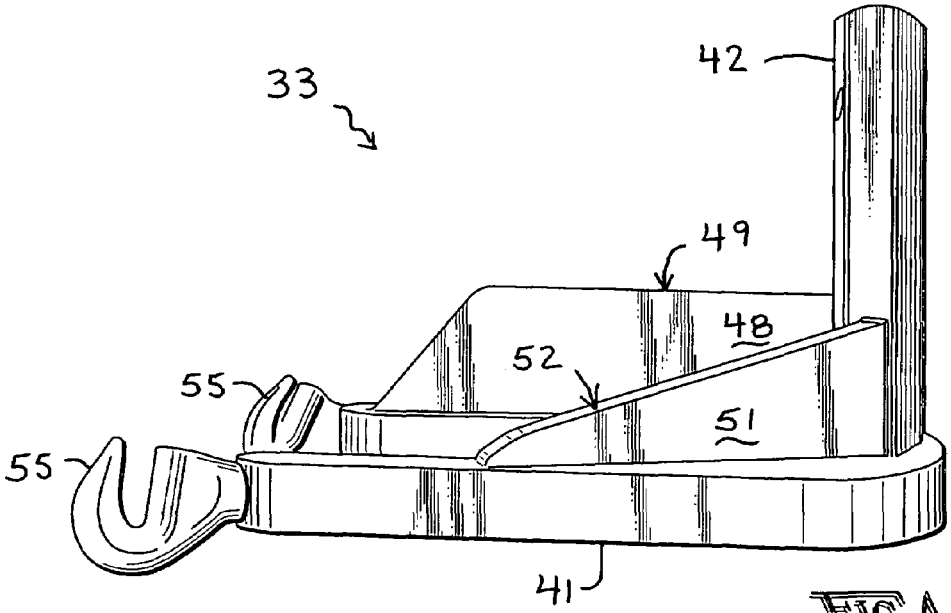
FIG. 4 is a side elevational view thereof.

FIGS. 3 and 4 show an alternate version of a retractor 33 in accordance with the invention. The terminations of the C-shaped base 41 are provided with chain hooks 55.

Figure 5:
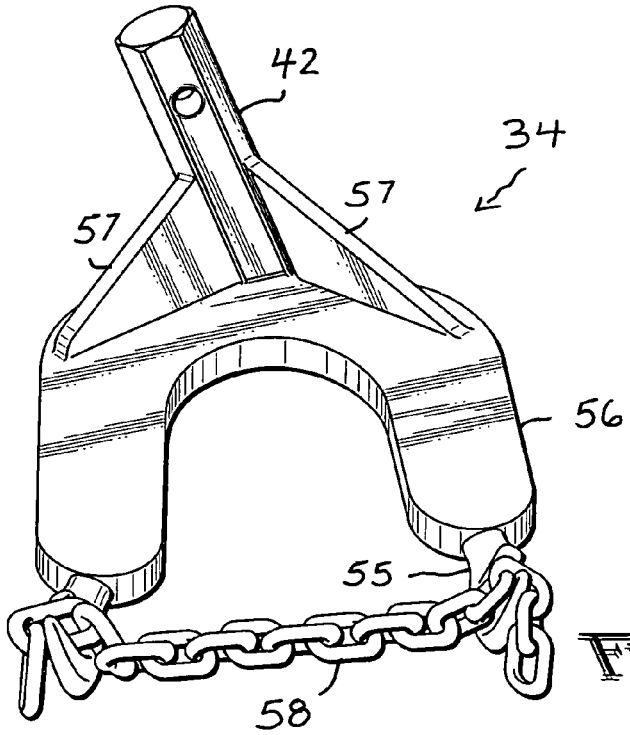
FIG. 5 is a perspective view of an alternate embodiment of the invention, and in contrast to the versions of the embodiment shown by FIGS. 1-4.
Figure 6:
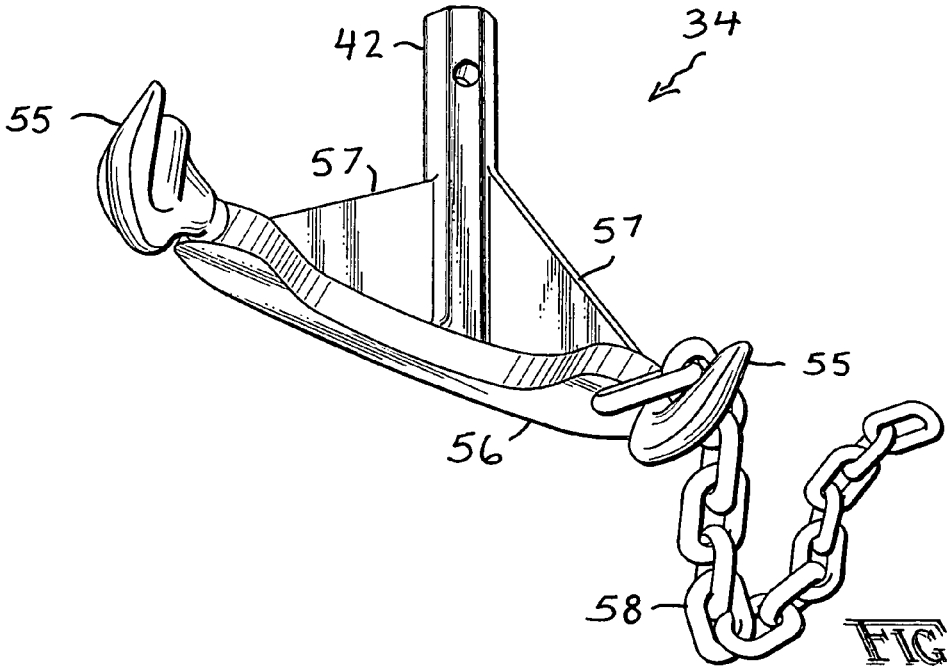
FIG. 6 is a front elevational view thereof.

FIGS. 5 and 6 show a more preferred embodiment of a retractor 34 in accordance with the invention. This retractor 34 comprises a tilted C-shaped base 56, the upright link 42, flanking strengthening gussets 57, and the chain hooks 55, as well as a companion chain 58 to provide an optional safety belt. The C-shaped base 56 is contained in a plain that is oblique to an axial plane containing the upright link 42. The dihedral angle therebetween is about forty-five degrees or so, but whatever, the dihedral angle is chosen to match the angle of the pitch of the helical flight 23.

Figure 14:
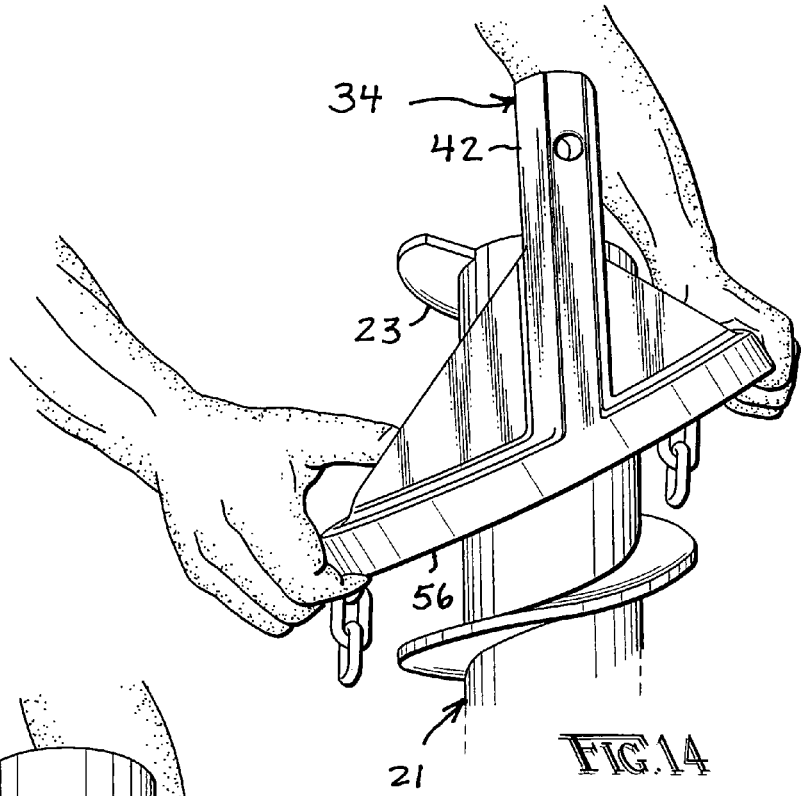
FIG. 14 is an enlarged scale perspective view comparable to FIG. 13 except showing the retractor aligned for a pull on the helical flight of the hollow stem auger section.
Figure 15:
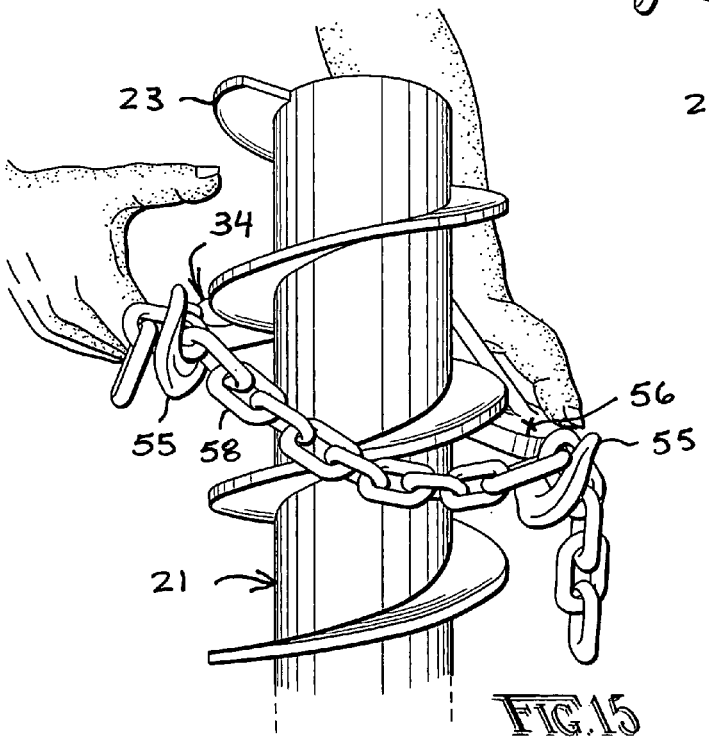
FIG. 15 is a perspective view comparable to FIG. 14 except the retractor is spun 180'.

Here in FIGS. 5 and 6, the gussets 57 are spaced sufficiently outboard (eg., outlying) such that they are not admitted between the coils of the helical flight 23 before the upright link 42 is stopped against the peripheral edge of the helical flight 23. As FIGS. 14 and 15 show better, only the C-shaped base 56 is admitted between a single coil of the helical flight 23. Thus, C-shaped base 56 desirably supports about three-quarters of a coil of the helical flight 23. The terminal chain-hooks 55 and chain 58 belt are safety features. However, not all embodiments of the inventive retractor 31 and 32 include such. The safety belt of chain 58 is more desirable for times when the retractor 33 or 34 is slack than when lifting. When lifting, the frictional grip between the retractor 31-34 and helical flight 23 is sufficient to keep things steady. But when the retraction pull is slackened, the retractor 31-34 might disengage due to imperfect alignment of the vertical hydraulics drive of the drill rig more than anything else. The chain 58 belt for retractors 33 and 34 prevents this.

Before describing the matters of FIGS. 9-13, a brief review of the prior art is helpful. As described above, prior art hollow stem auger hoists (not shown) typically have just one hook to insert in one or the other of the two diametrically opposed pin holes 26 in the cylindrical top-collar 22 of a section 21 of hollow stem auger. Shortcomings with the prior art include that the single hook (1) pulls the string of hollow stem auger sections 21 from an axis that is offset from the central axis of the string, (2) and in consequence tends to bind the single hook in the top collar 22's pin hole 26, both tending to deform the pin hole 26 as well as making work difficult for a worker to manually pull the hook out of pin hole 26, and then (3) when workers winch the bare hook up around the work site, it frequently catches a piece of equipment or the superstructure of the drill tower. Hence the hook can catch and damage a piece of equipment or such structure/superstructure thereof.

Figure 9:
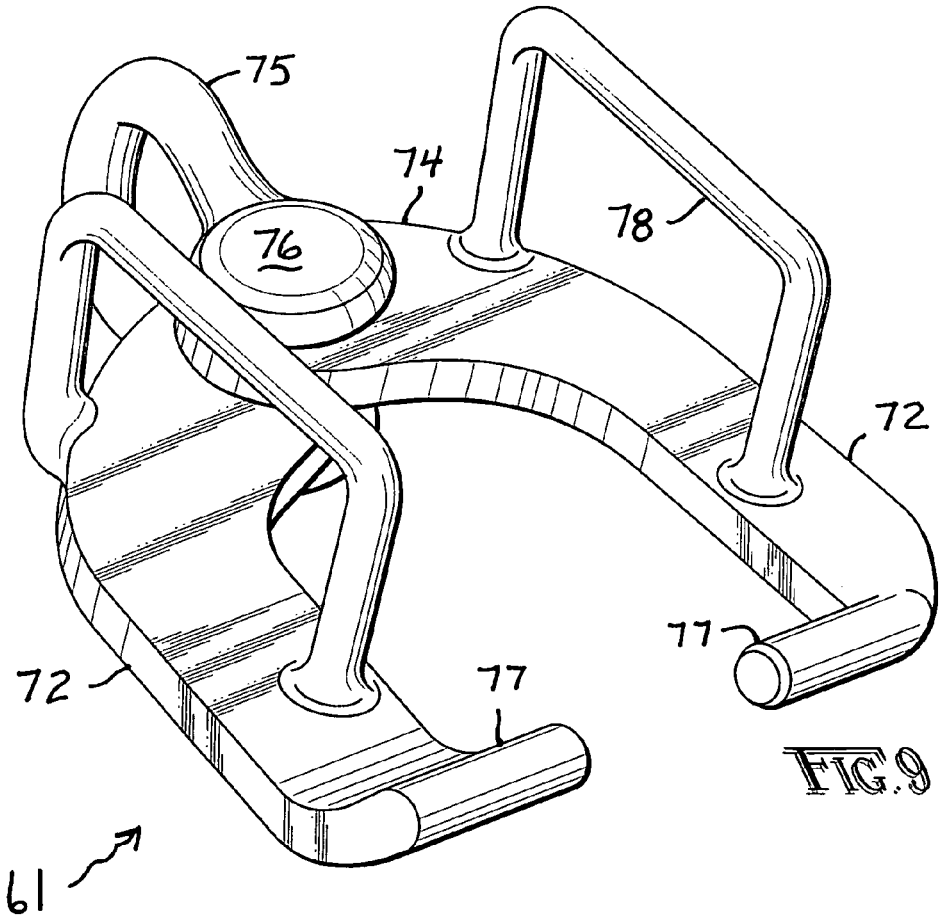
FIG. 9 is perspective view of a hoist in accordance with the invention for a hollow stem auger section.
Figure 10:
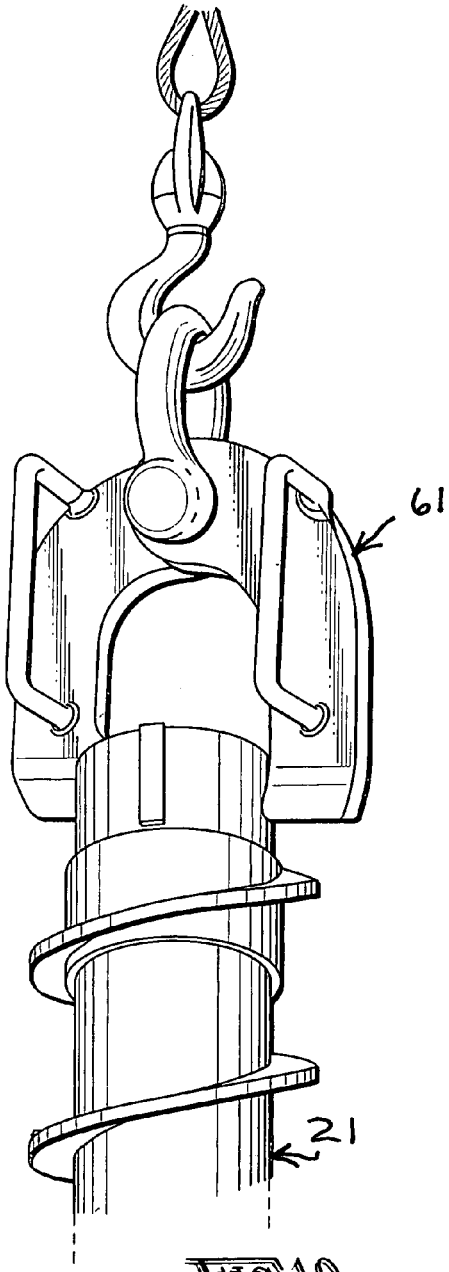
FIG. 10 is a reduced scale perspective view of the hoist in FIG. 9, except shown herein coupled to the top collar of a hollow stem auger section.

FIG. 9 shows a hoist 61 in accordance with the invention for grappling the pin holes 26 of the top collar 22 of a section 21 at the topmost position in the hollow stem auger string. The hoist 61 comprises a pair of depending and relatively symmetric arms 72 having rounded shoulders 74 to slide through equipment without catching on ledges or things when being elevated up. The arms 72 are pivoted together by a shackle 75 and pivot bolt 76. The arms 72 terminate at the lower ends thereof in opposed pins 77. The arms 72 are furthermore provided with a worker convenience comprising handle-bars 78.

The inventive hoist 61 is safer and kinder to equipment and workers. That is, the inventive hoist 61 overcomes the shortcomings of the prior art by (1) pulling the hollow stem auger string directly along an axis coincident with the central axis of the string, (2) its opposing pins 77 do not tend to bind in the opposite pin holes 26 of the engaged section 21's top collar 22, and hence the pins 77 are readily disengaged by workers in the field (which anyway is an operation greatly assisted by the convenient handle-bars 78). Additionally, (3) when winching the bare inventive hoist 61 up on the cable around the work site, the inventive hoist 61 is streamlined by virtue of the arms 72's rounded shoulders 74, and so the inventive hoist 61 does not find ways to inconveniently catch onto equipment or structure but instead tends to slide itself laterally out of the way and around.

Hence the inventive hoist 61 avoids catching and damaging equipment or the structure/superstructure thereof.

Figure 16:
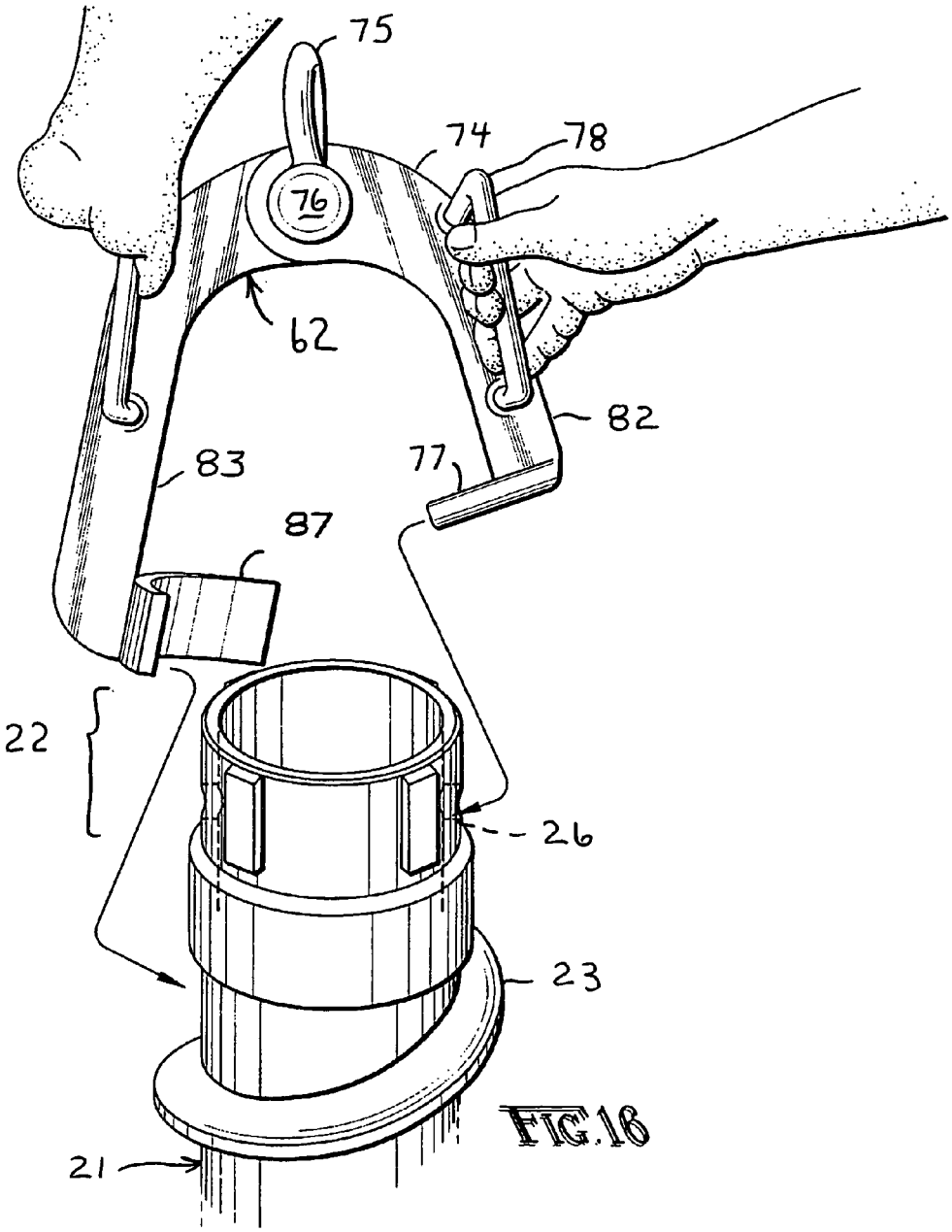
FIG. 16 is a perspective view comparable to FIG. 12 except showing an alternate embodiment of a hoist in accordance with the invention.
Figure 17:
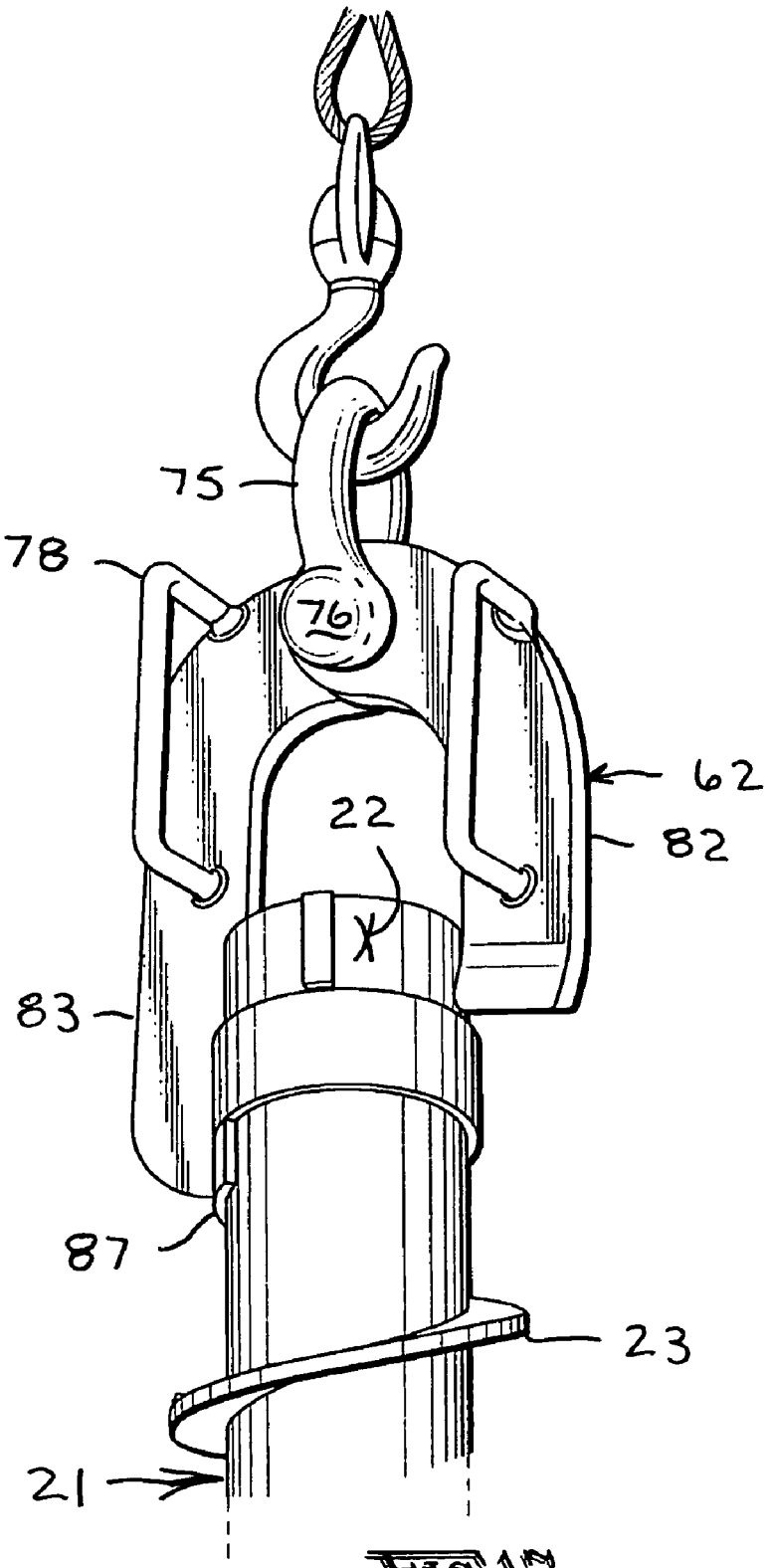
FIG. 17 is a perspective view comparable to FIG. 16 except showing the hoist thereof coupled to the top collar of a hollow stem auger section.

FIGS. 16 and 17 shows an alternate version of a hoist 62 in accordance with the invention for grappling the pin holes 26 of the top collar 22 of a section 21 at the topmost position in the hollow stem auger string. The hoist 61 comprises a pair of depending and asymmetric arms 82 and 83, the arm 82 being relatively shorter than the relatively longer arm 83. Like the FIG. 9 version of the hoist 61, this hoist 62's arms 82 and 83 have rounded shoulders 74 for the same inventive advantages. The arms 82 and 83 are also likewise pivoted together by a shackle 75 and pivot bolt 76. Like the FIG. 9 version of the hoist 61, this hoist 62's short arm 82 terminates at the lower end thereof in an inwardly disposed pins 77. However, unlike the FIG. 9 version of the hoist 61, this hoist 62's long arm 83 terminates at the lower end thereof in a side pad or saddle 87 for resting against the stem of the hollow stem auger section 21 at an elevation below the top collar 22. Comparable to the FIG. 9 version of the hoist 61, this hoist 62 is comparably provided with comparable handle-bars 78 for worker convenience.

FIG. 16 shows better that the side pad or saddle 87 is not attached symmetrically to the long arm 83 but asymmetrically. Presumptively, a symmetric arrangement of the side pad or saddle 87 on the long arm (this is not shown) would provide more evenly distributed support against the stem of the auger section 21 in opposition to the support and lifting of the pin 77 of the short arm. However, the advantage of the asymmetric arrangement of the side pad or saddle 87 on the long arm—as shown—includes convenience for workers to more easily engage and disengage the hoist 62 without having to spread the arms 82 and 83 as far apart than otherwise.

The advantages of these pair of accessories in accordance with the invention, comprising any retractor 31-34 of any of FIGS. 1-6 or the hoists 61 or 62 of FIG. 9 or 16, include the following. That is, these accessories 31-34 and 61-62 afford the practice of a method in accordance with the invention for hoisting the hollow stem auger string. This needs to be appreciated in context of constructing a well. The PVC pipe is down-fed to extend up and down the entire length of the lumen of the hollow stem auger string. According to the example previously given (and without limitation), the lumen of the hollow stem auger string might measure about 4-'/ inches (~11 cm) inside diameter. The PVC pipe typically measures about 2⅓ inches (~6 cm). During this time, an extension of the PVC pipe is left poking up out the lumen.

Figure 7:
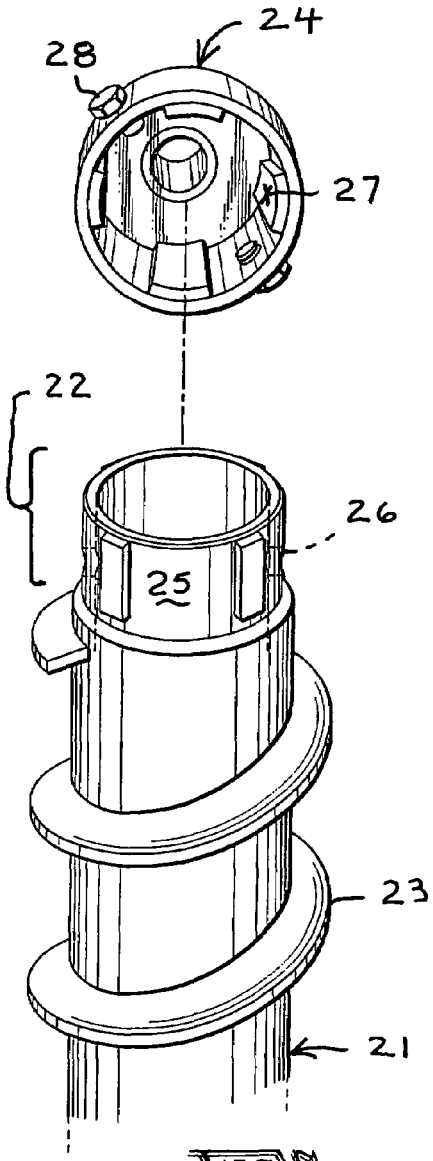
FIG. 7 (PRIOR ART)
FIG. 7 is a perspective view of a prior art drill cap for coupling to the top collar of a hollow stem auger section as well as showing a top collar of such a hollow stem auger section.
Figure 8:
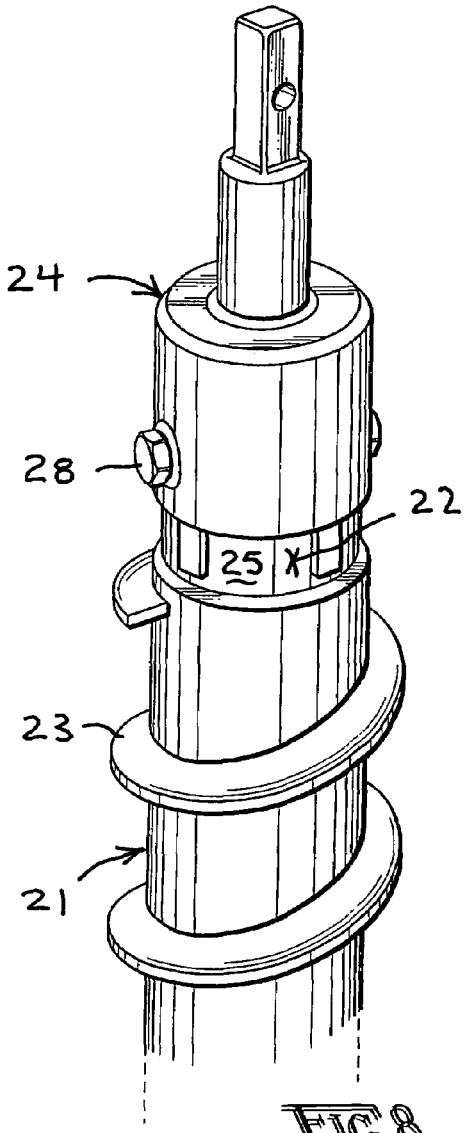
FIG. 8 (PRIOR ART)
FIG. 8 is a perspective view comparable to FIG. 7 showing the coupling therebetween.

Hence the drill cap 24 (eg., FIG. 7 or 8) cannot be coupled to the top collar 22 of the hollow stem auger section 21 at the topmost position of the hollow stem auger string. Either because sand, mud or grout has caked and fouled the top collar 22 or else because the poking up PVC pipe is in the way. Hence drillers have been accustomed to the prior art single hook method of withdrawing the hollow stem auger string, and then continuing to use the hook to support the topmost hollow stem auger section as it is disengaged from the string and set aside (eg., as on the ground, or on storage racks).

Again, when constructing a well, workers usually have made a mess (understandably so, since it is a messy process in a messy environment) on the top collar 22 of the topmost section of the hollow stem auger string. Hence they cannot reliably get the drill cap 24 to couple. Sometimes, the PVC casing pipe floats up a little bit which adds to the height of the poking up part. So to date workers in this industry have been predominantly relying on the single hook device of the prior art.

In accordance with the invention, two accessories replace the job of the lone prior art hook, but nevertheless there is overall a net gain in efficiencies and/or advantages. The various embodiments of the retractor 31-34 in accordance with the invention allows workers to lift the hollow stem auger string with the strong hydraulics of the drill rig if the winches are insufficiently powerful enough to do so by the inventive embodiments of the hoist 61 or 62. Otherwise, the inventive embodiments of the hoist 61 or 62 can do the job alone.

So, the job can be accomplished by the following steps. A basic step comprises lifting the auger string with the powerful hydraulics of the drill rig by any of the inventive embodiments of the retractor 31-34 (now, as an aside, sections 21 are only taken apart after a prior art catcher has been inserted between a coil of the helical flighting 23 of the section 21 which succeeds to the topmost position for the auger string to prevent the auger string from sinking back into the hole). Then, the chosen retractor 31-34 is disengaged if used, so that the section 21 in the topmost position of the auger string section can be disassembled from the remaining string, and carried away with the winch and tower of the drill rig by the chosen embodiment of inventive hoist 61 or 62.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A method of withdrawing a string or end-to-end assembly of hollow stem auger sections from a bore hole for a well, comprising the steps of:

given an above-ground stub of the string, engaging some portion of the above-ground stub's helical flighting from underneath with a retractor; and applying a lifting force through the retractor in order to withdraw the string or end-to-end assembly of hollow stem auger sections by some measure at least greater than one section;

wherein the step of engaging some portion of the above-ground stub's helical flighting from underneath with a retractor further comprises providing the retractor with a C-shaped inter-coil insertion and inserting such in a gap between a coil of the helical flighting such that the C-shaped inter-coil insertion straddles the stem and engages some portion of the helical flighting from underneath.

2. The method of claim 1 further comprises providing the retractor with an upright link extending from a connection to the C-shaped inter-coil insertion to an upper end adapted for connection to a drill rig's hoisting equipment.

3. The method of claim 2 further comprises fixing the upright link and C-shaped inter-coil insertion in fixed connection such that a dihedral angle is formed therebetween adapted to match the angle of pitch of the helical flighting.

4. The method of claim 3 further comprising connecting the upright link to the C-shaped inter-coil insertion along an outboard periphery thereof so as not to be admitted between the coils of the helical flighting.

5. The method of claim 4 wherein the step of applying a lifting force through the retractor in order to withdraw the string or end-to-end assembly of hollow stem auger sections by some measure at least greater than one section further comprises coupling the retractor's upright link to a drilling rig's hydraulic-cylinder powered vertical drive system.

6. The method of claim 1 further comprising configuring the C-shaped inter-coil insertion to undergird about three-quarters of a coil of helical flighting.

7. The method of claim 1 further comprising providing the C-shaped inter-coil insertion with a releasable belt connection between the terminations thereof to complete a belting around the stem in order that, prior til the application of lift is applied or else after slackened, the C-shaped inter-coil insertion does not displace out of undergirding alignment.

8. The method of claim 7 wherein the step of providing the C-shaped inter-coil insertion with a releasable belt connection between the terminations thereof further comprises providing the terminations thereof with respective chain hooks and further providing a chain to complete the belting around the stem.

9. A method of withdrawing a string or end-to-end assembly of hollow stem auger sections from a bore hole for a well, comprising the steps of:

given an above-ground stub of the string, engaging some portion of the above-ground stub's helical flighting from underneath with a retractor; and applying a lifting force through the retractor in order to withdraw the string or end-to-end assembly of hollow stem auger sections by some measure at least greater than one section;

wherein the step of applying a lifting force through the retractor in order to withdraw the string or end-to-end assembly of hollow stem auger sections by some measure at least greater than one section includes leaving a remainder, if any, comprising a new above-ground stub therefor in replacement of the previous.

10. The method of claim 9 further comprising repeating the steps until the string as a whole is withdrawn.

11. A retractor for earth-boring tubular rod having helical flighting, comprising:

a C-shaped collar adapted to insert in a gap between a coil of the helical flighting such that the C-shaped collar straddles the rod and engages some portion of the helical flighting from underneath; and an upright link extending from a connection to the C-shaped collar to an upper end adapted for connection to a drill rig's hoisting equipment;

wherein the upright link and C-shaped collar are connected in a fixed connection such that a dihedral angle is formed therebetween adapted to match the angle of pitch of the helical flighting.

12. The retractor of claim 11 wherein the upright link is connected to the C-shaped collar along an outboard periphery thereof so as not to be admitted between the coils of the helical flighting.

13. The retractor of claim 11 wherein the C-shaped collar further comprises a releasable belt connection between the terminations thereof to complete a belting around the rod in order that, prior til the application of lift is applied or else after slackened, the C-shaped collar does not displace out of undergirding alignment underneath the helical flighting.

14. The retractor of claim 13 wherein the C-shaped collar further comprises providing the terminations thereof with respective chain hooks and further providing a chain to complete the belting around the rod.

* * * * *